US006394077B1

(12) United States Patent
Choi

(10) Patent No.: US 6,394,077 B1
(45) Date of Patent: May 28, 2002

(54) EXHAUST GAS RECIRCULATION SYSTEM

(75) Inventor: Min-Seon Choi, Kyungki-do (KR)

(73) Assignee: Hyundai Motor Company, Seoul (KR)

( * ) Notice: Subject to any disclaimer, the term of this patent is extended or adjusted under 35 U.S.C. 154(b) by 0 days.

(21) Appl. No.: 09/919,624

(22) Filed: Jul. 30, 2001

(30) Foreign Application Priority Data

Sep. 15, 2000 (KR) ..... 00-54136

(51) Int. Cl.[7] ..... F02M 25/07
(52) U.S. Cl. ..... 123/568.14; 123/90.15
(58) Field of Search ..... 123/568.14, 90.15, 123/90.12, 90.39, 320

(56) References Cited

U.S. PATENT DOCUMENTS 4,187,810 A * 2/1980 Buehner ..... 123/16
4,723,516 A * 2/1988 Slagley et al. ..... 123/90.16
6,257,213 B1 * 7/2001 Maeda ..... 123/321

* cited by examiner

*Primary Examiner*—Andrew M. Dolinar
*Assistant Examiner*—Arnold Castro
(74) *Attorney, Agent, or Firm*—Christie, Parker & Hale, LLP

(57) ABSTRACT

An EGR system includes an intake and an exhaust valve arranged in a cylinder head of an engine, a first link pivotally supported by the cylinder head using a first pivot member for actuating the intake valve, a second link pivotally supported by the cylinder using a second pivot member for actuating the exhaust valve, an EGR adjuster connected to a proximal end of the first link and contacted a lower surface of the second link for adjusting exhaust valve opening.

10 Claims, 2 Drawing Sheets

EXHAUST GAS RECIRCULATION SYSTEM

CROSS REFERENCE TO RELATED APPLICATIONS

BACKGROUND OF THE INVENTION

This application claims priority of Korea patent Application No. 2000-54136, filed on Sep. 15, 2000.

(a) Field of the Invention

The present invention relates to an exhaust gas recirculation (EGR) system, and more particularly, to an improved exhaust gas recirculation system capable of controlling an amount of recirculating exhaust gas according to exterior temperature.

(b) Description of the Related Art

The EGR system is a system for recirculating a portion of exhaust gas to an intake part of an engine so as to reduce generation of nitrogen oxides (NOx). Typically, the EGR system comprises an EGR valve connecting the exhaust and intake manifolds and which controls an amount of recirculating exhaust gas according to a state of the intake manifold such that some of the exhaust gas flows into the intake manifold having a relatively lower pressure than the exhaust manifold, when the EGR valve is opened. There are two kinds of EGR valves, i.e., a pneumatic EGR valve using pressure difference between the intake and exhaust manifolds, and an electronic EGR valve using solenoid valves. The pneumatic EGR valve is used in small size engines requiring an EGR amount of 5~10% and the electronic EGR valve in relative large size engines requiring an EGR amount of 15~20%.

FIG. 1 is a schematic view of a conventional pneumatic EGR system. As shown in FIG. 1, intake air is supplied to an engine 20 via an air cleaner 12, throttle body 14 and intake manifold 18. The amount of intake air is adjusted by a throttle valve 16 arranged in the throttle body 14. The intake air is mixed with fuel in combustion chambers of the engine and the exhaust emission after combustion of the mixed gas is exhausted through the exhaust manifold 22. From an initial closed state, the EGR valve 26 opens by pressure difference between the intake and exhaust manifolds 18 and 22 of the engine 20 when the throttle valve 16 is closed, that is, the intake part pressure becomes lower than the exhaust part pressure such that a valve plate 23 moves upward by overcoming an elastic force of a spring 27 of the EGR valve 22 so as to open an EGR passage 24, resulting in exhaust gas flowing into the intake part. A reference numeral 28 indicates an EGR-back pressure transducer (EGR-BPT) valve which adjusts pressure level applied to the EGR valve 26.

However, this conventional EGR system has a drawback in that the structure is complicated and requires many parts. Also, the electronic EGR valve requires a complicated EGR logic system and gives much processing burden to a controller.

SUMMARY OF THE INVENTION

The present invention has been made in an effort to solve the above problems of the prior art.

It is an object of the present invention to provide an improved EGR system capable of adjusting an amount of exhaust gas recirculated into a combustion chamber according to exterior temperature.

To achieve the above object, an EGR system comprises an intake and an exhaust valve arranged in a cylinder head of an engine, a first link pivotally supported by the cylinder head using a first pivot member for actuating the intake valve, a second link pivotally supported by the cylinder head using a second pivot member for actuating the exhaust valve, and an EGR adjuster connected to a proximal end of the first link and contacting a lower surface of the second link for adjusting exhaust valve opening.

BRIEF DESCRIPTION OF THE DRAWINGS

The accompanying drawings, which are incorporated in and constitute a part of the specification, illustrate an embodiment of the invention, and together with the description, serve to explain the principles of the invention.

DETAILED DESCRIPTION OF THE PREFERRED EMBODIMENTS

A preferred embodiment of the present invention will be described hereinafter with reference to the accompanying drawings. In the following detailed description, only the preferred embodiment of the invention has been shown and described, simply by way of illustration of the best mode contemplated by the inventor of carrying out the invention. As will be realized, the invention is capable of modification in various obvious respects, all without departing from the invention. Accordingly, the drawings and description are to be regarded as illustrative in nature, and not restrictive.

Figure 1:
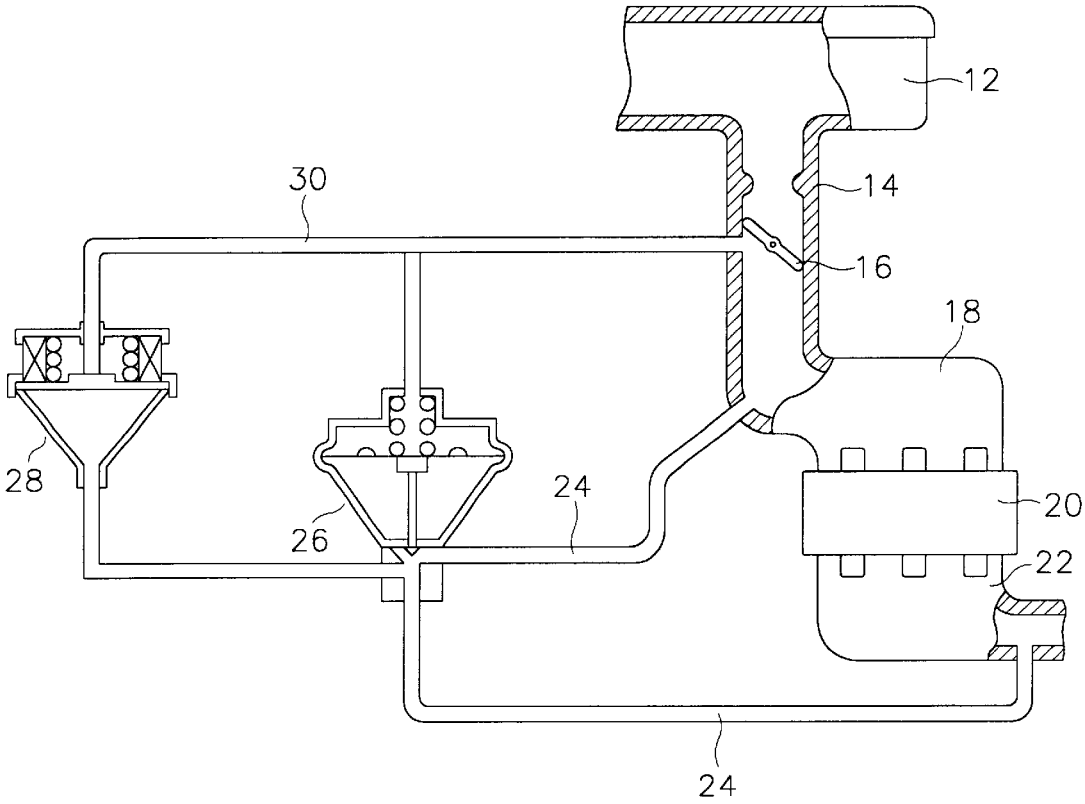
FIG. 1 is a schematic view showing a prior art EGR system.
Figure 2:
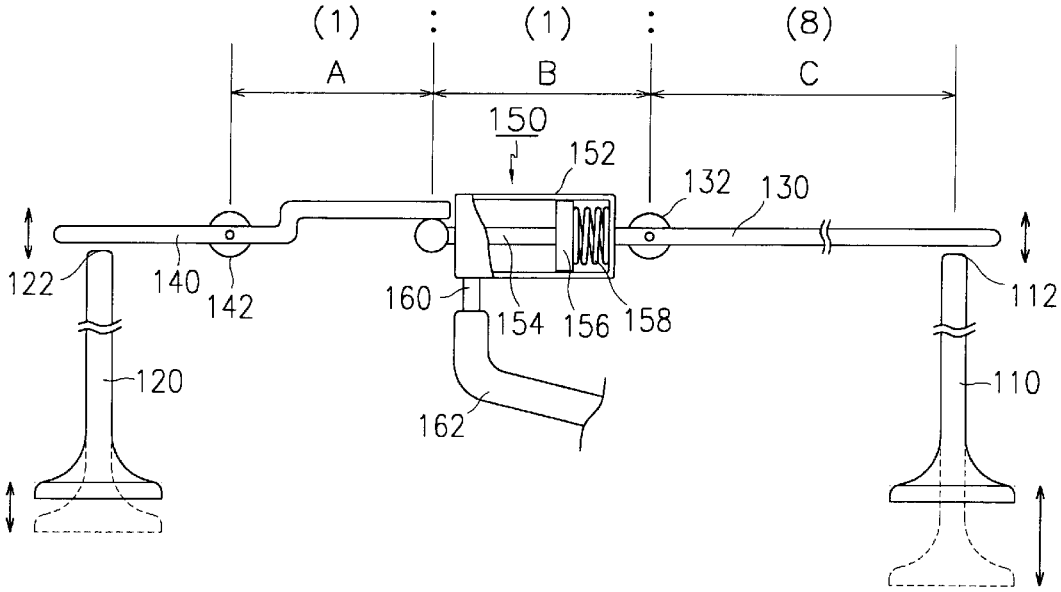
FIG. 2 is a front view illustrating an EGR system according to a preferred embodiment of the present invention when an EGR amount is small.
Figure 3:
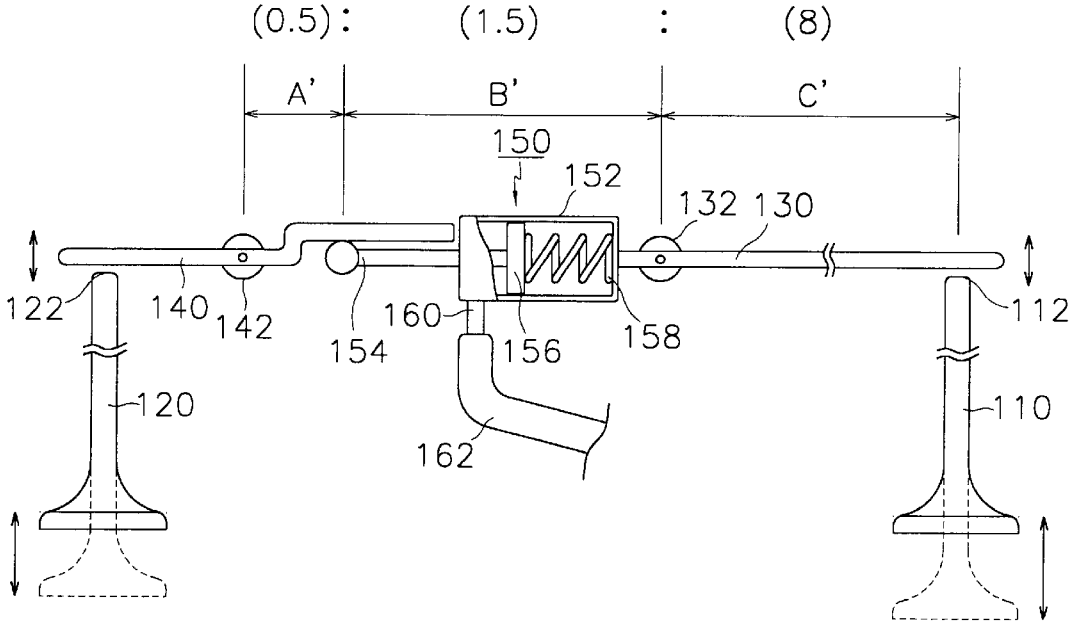
FIG. 3 is a front view illustrating the EGR system of FIG. 2 when the EGR amount is large.

FIG. 2 and FIG. 3 are respective front views illustrating an EGR system according to a preferred embodiment of the present invention when an EGR amount is small and large.

The EGR system of the present invention comprises an intake and an exhaust valve 110 and 120, a first link 130 pivotally supported by a cylinder head (not shown) using a first pivot 132 approximately at its middle portion and one end of which is perpendicularly contacting an upper end 112 of the intake valve 110, a second link 140 pivotally supported by a cylinder head using a second pivot 142 approximately at its middle portion and one end of which is perpendicularly contacting an upper end 122 of the exhaust valve 120, and an EGR adjuster 150 interposed between the first and second links 130 and 140, the EGR adjuster 150 being connected to the other end of the first link 130 and contacting the other end of the second link 140.

The first and second links 130 and 140 can be rocker arms appropriately modified for being adapted to the present invention or separate members that can cooperate with the corresponding rocker arms.

The EGR adjuster 150 comprises a cylindrical housing 152 integrally connected to the end of the first link 130 in a longitudinal direction, a piston rod 154 with a plunger 156 tightly inserted into the housing so as to separate an inner space of the housing into left and right compartments, with one end of the piston rod 154 protruding outside the housing 152 such that a distal end of the piston rod 154 contacts a lower surface of the second link 140, a coil spring 158 installed in the right compartment defined so as to bias the plunger 156 in a left direction, a thermal sensitive material stored in the left compartment of the housing 152, and an air port 160 connected to the compartment where the thermal sensitive material is stored such that the thermal sensitive material expands to push the plunger 156 by overcoming the elastic force of the coil spring 158 when it is exposed to high temperature air from the air port 160. The air port 160 is connected to an air passage 162 which communicates outside for guiding outside air.

The operation of the above structured EGR system will be described hereinafter.

The first and second links 130 and 140 act as rocker arms so as to actuate the intake and exhaust valves 110 and 120. The second link 140 independently actuates the exhaust valve 120 during an exhaust stroke of the engine. At the same time the first link 130 actuates the intake valve 110 to be opened, it causes the second link 140 to responsively actuate the exhaust valve 120 to be opened. That is, during an intake stroke of the engine, the first link 130 rotates in a clockwise direction such that the distal end of the first link 130 pushes down the intake valve 110 and the other end of the first link 130 moves upward. Accordingly, the distal end of the piston rod 154 of the EGR adjuster 152 pushes up the one end of the second link 140 since the distal end of the piston rod 154 contacts the lower surface of the second link 140 such that the second link 140 rotates in a counter clockwise direction, resulting in the distal end of the second link 140 pushing down the exhaust valve 120 and opening it.

During this intake operation of the engine, an opening amount of the exhaust valve 120 is determined by a rotational angle of the second link 140 and the rotational angle of the second link is determined by a distance "B" between the second pivot 142 and a contact point where the second link contacts the end of the piston rod 154. That is, the shorter the distance "B", the larger the rotational angle of the second link 140 and also the opening amount of the exhaust valve 120.

The distance "B" varies according to how much the piston rod 154 is protruded out of the housing 152 of the EGR adjuster 150 by the elastic force of the spring 158. Protrusion of the piston rod 154 is limited by a volume of the thermal sensitive material stored in the left compartment of the housing 152. The thermal sensitive material can be a material that sensitively expands and contracts according to temperature, such wax pellets used in thermostats.

As shown in FIG. 2, the thermal sensitive material expands when it is exposed to high temperature air guided through the air port 160 and air passage 162. In this case, the thermal sensitive material expands to push the plunger 156 to the right by overcoming the elastic force of the coil spring 158 such that the piston rod 154 withdraws into the housing 152, resulting in the length "B" being maximized. Accordingly, the second link 140 rotates a small angle in the counter clockwise according to the rotation of the first link 130 in a clockwise direction during the intake stroke of the engine such that the exhaust valve 120 opens a small amount in order to let in a small amount of the exhaust gas remaining in an exhaust manifold (not shown).

In FIG. 3, the thermal sensitive material is contracted when it is exposed to a lower temperature air from outside, such that the plunger 156 moves to the left by the elastic force of the coil spring 158. This causes the piston rod 154 to be fully protruded out of the housing 152 such that the length "B" is shortened to cause the second link 140 to sensitively rotate in a counter clockwise direction in response to the rotation of the first link 130 in a clockwise direction during the intake stroke of the engine. Accordingly, the exhaust valve 120 opens so as to let in a relatively large amount of the exhaust gas remaining in the exhaust manifold.

It is preferred that a ratio among the distances "A" between the second pivot 142 and the contact point of the second link 140 with the upper end of the exhaust valve 120, "B" between the second pivot 142 and the contact point of the second link 140 with the distal end of the piston rod 154, "C" between the contact point of the second link 140 with the distal end of the piston rod 154 and the first pivot 132 of the first link 130, and "D" between the first pivot 132 and the contact point of the first link 130 with the upper end of the intake valve 110 is 1:1:1:8 when the air temperature from the air port 160 is higher than a first predetermined threshold temperature, i.e., when the piston rod 154 is fully withdrawn into the housing 152 such that the intake and exhaust valves open in a ratio of 8:1 during the intake stroke of the engine, as show in FIG. 2.

Also, it is preferred that the ratio among the distances "A," "B," "C," and "D" is 1:0.5:1.5:8 when the air temperature from the air port 160 is lower than a second predetermined threshold temperature, i.e., when the piston rod 154 is fully extended out of the housing 152 such that the intake and exhaust valves open in a ratio of 8:3 during the intake stroke of the engine, as shown in FIG. 3.

The opening ratio can continuously vary between the ratios 8:1 and 8:3 according to the outside temperature change.

As described above, the EGR system of the present invention can adjust the EGR amount by controlling the exhaust valve opening according to the outside temperature such that the EGR amount increases in the cold weather of winter and decreases in the hot weather of summer, resulting in efficiently reducing nitrogen oxide (NOx) emissions.

Furthermore, since this EGR system works without the requirement of the conventional elements such as EGR valves and passages for recirculating the exhaust gas, the structure and EGR operation are simplified and EGR performance is improved.

What is claimed is:

1. An EGR system comprising:

an intake and an exhaust valve arranged in a cylinder head of an engine;

a first link pivotally supported by the cylinder head using a first pivot member for actuating the intake valve;

a second link pivotally supported by the cylinder head using a second pivot member for actuating the exhaust valve; and an EGR adjuster connected to a proximal end of the first link and contacting a lower surface of the second link for adjusting exhaust valve opening.

2. An EGR system of claim 1 wherein the first link contacts an upper end of the intake valve at a distal end portion thereof for pushing down the intake valve during an intake stroke of the engine.

3. An EGR system of claim 1 wherein the second link contacts an upper end of the exhaust valve at a distal end portion thereof for pushing down the exhaust valve during an intake stroke of the engine.

4. An EGR system of claim 1 wherein the EGR adjuster comprises:

a cylindrical housing connected to the proximal end of the first link in a longitudinal direction;

a piston rod having a plunger tightly inserted into the housing for separating inner space of the housing into first and second compartments;

a coil spring installed in the first compartment for biasing the plunger in a predetermined direction;

a thermal sensitive material stored in the second compartment for limiting movement of the plunger; and an air port formed on the housing for communicating with the second compartment and an air passage to guide exterior air therethrough, wherein an end of the piston rod contacts a lower surface of the second link.

5. An EGR system of claim 4 wherein the thermal sensitive material expands or contracts according to temperature.

6. An EGR system of claim 4 wherein the piston rod reciprocates according to whether the thermal sensitive material expands or contracts such that a length of a protruded portion of the piston rod varies.

7. An EGR system of claim 4 wherein a ratio among a distance "A" between a contact point of the second link with the upper end of the exhaust valve and a second pivot point of the second link, a distance "B" between the pivot point of the second link and a point of contact between the lower surface of the second link and the end of the piston rod, a distance "C" between the contact point of the second link with the piston rod and a first pivot point of the first link, and a distance "D" between the first pivot point of the first link and the upper end of the intake valve is 1:1:1:8 when the piston rod is fully contracted into the housing.

8. An EGR system of claim 7 wherein a ratio of exhaust valve opening to intake valve opening is 1:8.

9. An EGR system of claim 7 wherein the ratio among the distances A, B, C, and D is 1:0.5:1.5:8 when the piston rod is fully extended out of the housing.

10. An EGR system of claim 9 wherein the ratio of the exhaust valve opening to the intake valve opening is 3:8.

* * * * *